United States Patent [19]

Psyras

[11] 4,216,611

[45] Aug. 12, 1980

[54] AERODYNAMIC TOY

[76] Inventor: Louis G. Psyras, 1384 Commonwealth Ave., Boston, Mass. 02135

[21] Appl. No.: 959,995

[22] Filed: Nov. 13, 1978

Related U.S. Application Data

[63] Continuation-in-part of Ser. No. 793,923, May 5, 1977, Pat. No. 4,132,031.

[51] Int. Cl.[3] ..... A63H 27/00

[52] U.S. Cl. ..... 46/74 D; 273/424

[58] Field of Search ..... 46/74 D; 273/106 B, 273/232; D21/85, 86

[56] References Cited

U.S. PATENT DOCUMENTS

| | | | |
|---|---|---|---|
| D. 210,791 | 4/1968 | Tally et al. | D21/85 |
| D. 241,565 | 9/1976 | Molenar | D21/86 |
| 2,135,210 | 11/1938 | Farrar | 273/232 |
| 3,082,572 | 3/1963 | Knox, Jr. | 46/74 |
| 3,185,480 | 5/1965 | Weyman et al. | 273/106 R |
| 3,359,678 | 12/1967 | Hendrick | 46/74 D |
| 3,724,122 | 4/1973 | Gillespie, Sr. | 46/74 D |
| 4,132,031 | 1/1979 | Psyras | 46/74 D |
| 4,151,997 | 5/1979 | Glovak et al. | 273/106 B |

FOREIGN PATENT DOCUMENTS

| | | | |
|---|---|---|---|
| 2306132 | 8/1974 | Fed. Rep. of Germany | 273/106 B |

*Primary Examiner*—Paul J. Hirsch

*Attorney, Agent, or Firm*—Herbert L. Gatewood

[57] ABSTRACT

An aerodynamic, saucer-shaped toy is provided for use in throwing games. The body of the toy is provided on its convex, upper surface with a plurality of radial extending air spoilers. These spoilers provide discontinuities to the flow of air so that in flight the air flow over the convex surface of the aerodynamic toy is disrupted, creating a turbulent air layer over the moving surface thereby somewhat reducing aerodynamic drag. A depression can be provided in the aerodynamic toy, centrally located in the convex surface, in which can be provided additional spoilers, as desired.

15 Claims, 8 Drawing Figures

AERODYNAMIC TOY

CROSS-REFERENCES TO RELATED APPLICATIONS

This patent application is a continuation-in-part of my earlier filed application, Ser. No. 793,923, filed May 5, 1977, for Aerodynamic Toy With Radial Elevations On Its Convex Side, now U.S. Pat. No. 4,132,031, issued Jan. 2, 1979.

BACKGROUND OF THE INVENTION (1) Field of the Invention

This invention relates to an aerodynamic toy of novel configuration to be thrown by hand through the air.

(2) Discription of the Prior Art

Aerodynamic toys resembling so-called "flying saucers", and which are thrown by hand through the air, have gained ever increasing popularity over the recent several years. Throwing is accomplished with a wrist snapping action wherein a spinning motion is imparted to the toy as it flies through the air. The direction of flight from the thrower in general depends upon the thrower's skill, and the type of flight path (e.g. curved or straight) depends somewhat upon the angle of the aerodynamic toy in relation to the ground, when it is released by the thrower. These saucers or aerodynamic toys fly as they do, i.e. when released approximately horizontal to the ground, apparently because they approximate an air foil. Hence, the toy's flight through the air is enhanced by aerodynamic lift.

Various toys of this type have been developed over the past several years, and they have been enjoyed by the young, and the not-so-young, in backyards, in playgrounds, at the seashore, and other recreational areas. Examplary of the prior art patents showing various of these aerodynamic toys are U.S. Pat. Nos. 2,659,178; D183,626; 2,835,073; 3,359,678; 3,566,532; 3,710,505; 3,828,466; 3,948,523; and 3,959,916.

While at least one of the aerodynamic toys heretofore available commercially has achieved a wide measure of popularity, and is found quite satisfactory in its performance, others of these aerodynamic toys have not been so popular. Some of these aerodynamic toys have provided relatively poor performance because they just don't have sufficient stability in flight and aerodynamic lift, as they are either too heavy or are too light, or of less suitable configuration for good flight performance, or the like.

As disclosed in my earlier filed patent application, which is above-mentioned, radial elevations of various configurations can be provided on the convex surface of the aerodynamic toy. These radial elevations act as secondary air foils or spoilers, providing the aerodynamic toy with good stability and performance in flight. In the inventions disclosed in that patent application, the radially disposed air spoilers are provided in combination with a centrally-located, cylindrical-shaped flat-topped body portion raised somewhat above the convex surface of the convex-concave body portion, and on its convex side. The air spoilers in that invention extend generally outwardly from the circumference of the centrally-located body portion, to the outside edge of the convex surface, or the beginning of the rim portion of the circular-shaped aerodynamic toy.

It had been thought up to the time of the present invention that a concentric body portion raised somewhat above the convex surface of the convex-concave body portion was needed, or at least desirable for good stability and performance in flight of the aerodynamic toy. The raised, centrally-located body portion was believed to act as a further, or secondary air foil. Now, however, I have discovered that a raised centrally-located body portion is not at all needed for good flight performance and stability, so long as radially extending air spoilers are provided on the convex upper surface of the aerodynamic toy.

SUMMARY OF THE INVENTION

In accordance with the present invention, I have now discovered that good stability and performance in the flight of an aerodynamic toy can be achieved without a raised, cylindrical-shaped body portion, concentric with the convex-concave circular-shaped body portion, so long as radially extending spoilers are provided on the convex surface. Thus, the center portion of the aerodynamic toy can be flat and a continuation of the smooth convex upper surface.

The "radial extending spoilers" of my invention, which are disposed equidistantly around the geometric center of the aerodynamic toy can take various configurations, e.g., a plurality of grooves can be inscribed in the convex surface, these grooves each being in alignment with, and at least a segment of, a radius of the circular-shaped aerodynamic toy. Between each two adjacent inscribed grooves is, of course, a defined raised or elevated portion of a pie shape.

In other instances, the radial extending spoilers, can take the configuration of a plurality of raised portions or elevations, provided on a smooth convex surface. These raised portions can be of arcuate cross-section, and of the same width along their entire length, or these radial extending spoilers can vary in width, from widest nearer the rim portion of the aerodynamic toy, to narrowest further away from the rim portion, or conversely. In any event the center line of the raised elevations will be in alignment with a radius of the circular-shaped body of the aerodynamic toy; however, the raised portion need not extend along a complete radius.

These radial extending spoilers, as will be appreciated, serve to interrupt the smooth flow of air during flight of the toy, over its convex surface. In aerodynamics, this action is referred to as "spoiling" the air flow, and the means by which this is accomplished are often referred to as "spoilers". Hence, the use of the term in this patent application.

As applied to the present invention, these radially extending spoilers on the convex surface of the aerodynamic toy are believed to create a turbulent unseperated boundry layer over the convex side of the aerodynamic toy, resulting to some extent in a reduction of drag, especially in high-speed flight, and an increase in stability while in flight. Moreover, it is believed that these spoilers create a more rapid flow of air over their curved surface, compared to the flow of air over the flat surfaces between them, and result in somewhat improved aerodynamic lift.

The aerodynamic toy of the present invention can be further provided, if desired, with a centrally-located depressed protion or well, in which case an assembly of secondary radially disposed air spoilers is preferrably disposed in the depression. This spoiler assembly comprises a plurality of planar flat-like spoilers located equidistant angularly about a central axis, the assembly being so positioned in the centrally-located depression or well that the axis of the assembly passes through the geometric center of the aerodynamic toy. The spoilers in the assembly are each located in alignment with a diameter of the circular-shaped body of the aerodynamic toy. The spoilers in the spoiler assembly can be of various configuration, e.g. a rectangular shape, or of a somewhat irregular shape.

BRIEF DESCRIPTION OF THE DRAWINGS

The invention will be better understood by referring to the drawings in which like numerals refer to like parts in the various views, and in which.

DETAILED DESCRIPTION OF THE INVENTION AND THE PREFERRED EMBODIMENTS

Figure 1:
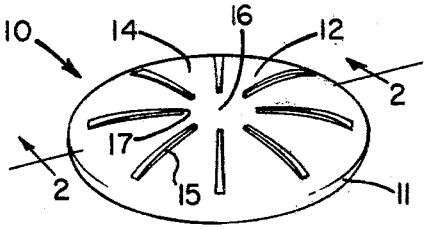
FIG. 1 is a view in perspective of an aerodynamic toy in accordance with the invention.

Turning now to the drawings there is shown in FIG. 1 thereof an aerodynamic toy in accordance with the invention comprising a rotatable free flight body of circular configuration defined by rim portion 11, integral with a main body portion 12. As shown in the drawing, main body portion 12 is of a convex-concave shape, the underneath concave surface 13 of which is smooth and uninterrupted. On the upper convex surface 14 are provided a plurality of radially extending air spoilers 15, these being disposed equidistant angularly about the geometric center of the aerodynamic toy 10. The convex surface between the spoilers is smooth, as is the underneath or concave surface 13.

Figure 2:
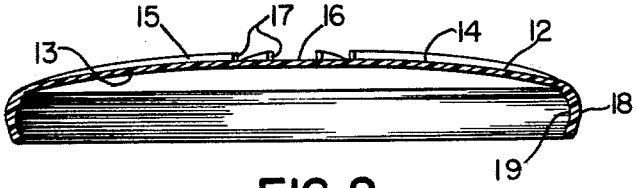
FIG. 2 is a view in cross-section of the aerodynamic toy shown in FIG. 1, taken at secant lines 2—2.

The longitudinal center line (not shown) of each air spoiler 15 lies on a radius of the circular-shaped aerodynamic toy 10. As will be appreciated, each air spoiler is of symmetrical configuration with respect to its center line. Turning to FIG. 2 of the drawing, it will be seen that the air spoilers 15 extend inwardly on the convex surface 14 from rim portion 11 toward the geometric center 16 of the aerodynamic toy. However, air spoilers 15 need not terminate at inner end 17, as indicated. The air spoilers 15 can, if desired all terminate at the geometric center. Or some of the air spoilers 15 can extend to the geometric center 16 while others extend only a partial distance of the radius from rim portion 11, toward the geometric center 16. In any event, whatever the configuration of air spoilers 15 provided on convex surface 14, symmetry shoud be a matter of consideration, so that the aerodynamic toy 10 will not be unbalanced in weight.

Air spoilers 15, as disclosed in FIG. 1 are seen to be wider nearer rim portion 11, than more closely adjacent the geometric center. However, the air spoilers can be provided of a varing width in the opposite direction, if desired. Air spoilers 15, as shown more clearly in FIG. 2 of the drawing, curve downwardly at the rim portion 11, blending smoothly into the convex surface 14 at its junction with the rim portion. And in cross-section the narrowing width air spoilers 15, while not quite arcuate shape, are provided with a rather smooth surface. Nevertheless, if desired, the air spoilers can be made of a more rectilinear shape, as disclosed in my earlier filed patent application. The air spoilers 15 can be of an arcuate shape in cross-section, the center line of which coincides with a radius of the aerodynamic toy, making for air spoilers of the same width throughout their length.

While as above-mentioned, these radial extending air spoilers 15 can extend from the rim portion 11 inwardly to the geometric center 16, it is deemed most important that such spoilers be at least provided adjacent rim portion 11, as this appears to be the most effective portion of the elongated spoiler devices for providing good stability and performance in flight of the aerodynamic toy 10. The radial extending portion raised above convex surface 14 acts as a spoiler or secondary air foil, during the time the aerodynamic toy 10 is spinning about its geometric center during flight.

Although the height and width of the raised portion or radially extending spoilers above convex surface 14 can vary somewhat, depending upon the particular circular size and weight desired in the aerodynamic toy, a height no greater than about one quarter inch will be, in general, found quite satisfactory. The most suitable width of an air spoiler in accordance with the invention will depend somewhat on the actual number of air spoilers provided on the convex surface, as well as their actual configuration, and the dimensions and weight of the aerodynamic toy provided.

Rim portion 11 of the aerodynamic toy 10 is provided integral with main body portion 12, and forms a downwardly turned smooth curve continuous with convex surface 14. As indicated in the drawing, the outside surface 18 of rim portion 11 curves downwardly and somewhat inwardly, approximating the shape of a parabola opening inwardly toward the central axis of the saucer-shaped body of the aerodynamic toy 10.

The inner surface 19 of rim portion 11 can take the same curved shape as outer surface 18; however, in general, it is desirable not to provide this inner surface, even though curved inwardly, parallel to outer surface 18. The rim portion 11 is desirably thicker than the main body portion 12, to provide a greater density in the rim portion. This makes for better flight and stability in performance.

The inner surface 19 of rim portion 11 can, if desired, be in part curved, nearer the concave surface 13 of main body portion 12 and then flat. Thus, a cylindrical-shaped inner surface can be provided in the rim portion, essentially concentric with the axis of the geometric center of the aerodynamic toy. In this manner a rim portion 11 of substantial thickness can be provided, to provide in the larger diameter aerodynamic toy, particularly, a rim portion of much greater weight, when greater weight is desired.

Figure 3:
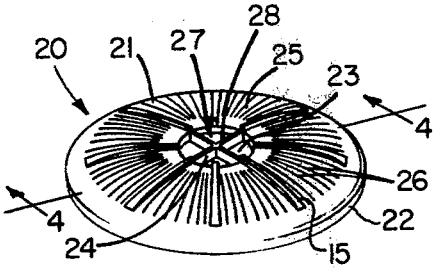
FIG. 3 is a perspective view of another embodiment of an aerodynamic toy in accordance with the invention.
Figure 4:
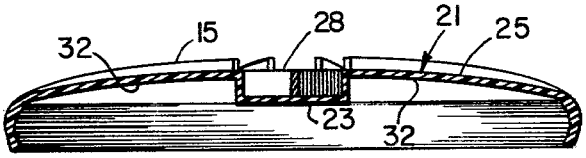
FIG. 4 is a view in cross-section of the embodiment of the aerodynamic toy shown in FIG. 3, taken at secant lines 4—4.
Figure 5:
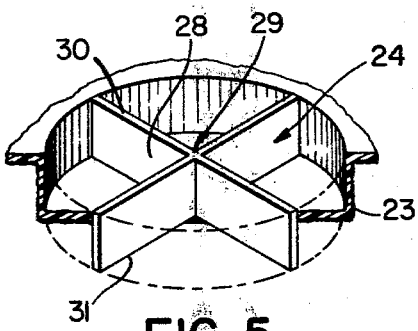
FIG. 5 is a view in perspective showing the depressed portion or well of the aerodynamic toy shown in FIG. 3 and the spoiler assembly disclosed therein.

Reference is now made more specifically to FIG. 3 of the drawing in which there is shown another aerodynamic toy 20 in accordance with the invention comprising a main body portion 21 and an integral rim portion 22. As shown in the drawing, there is provided in the main body portion 21 a centrally-located depression or well 23 in which is, most preferably, located a spoiler assembly 24. Spoiler assembly 24 can be of various structural configurations, as will be later more fully disclosed. This assembly acts as a further means, in addition to the radially extending spoilers, to disturb or spoil the air flowing over the top convex surface 25 of the aerodynamic toy 20. Thus, aerodynamic drag is reduced to a degree and somewhat better lift is provided in the aerodynamic toy 20.

On the convex surface 25 of aerodynamic toy 20 there are provided a combination of a plurality of radially extending air spoilers designated, in general, by reference numerals 15 and 26. Air spoilers 15 are of the same structural configuration as those already disclosed in connection with the description of aerodynamic toy 10; however, in addition to this particular configuration of radially extending spoilers, there are also provided on the convex surface 25 of aerodynamic toy 20 further radially extending air spoilers 26, inscribed as grooves in the convex surface of the main body portion 21. The grooves each coincide with a radius of the circular-shaped aerodynamic toy 20; however, they extend inwardly from rim portion 22 only a part of the distance toward the geometric center 27.

As will be appreciated, the actual number of any particular configuration of radially extending air spoilers provided can be varied, as desired. The number appropriate for optimum performance in flight will be determined somewhat by the size and weight of the aerodynamic toy, as well as the particular configuration of air spoilers provided, and the dimension thereof. A most important consideration regardless of the air spoiler configuration provided, or their number, is that symmetry must be maintained. Otherwise, the aerodynamic toy will be weight unbalanced.

In the case of the aerodynamic toy disclosed in FIG. 3 of the drawing having a diameter of 9 and ½ inches, there are provided 8 air spoilers of the configuration designated generally by reference numeral 15 of the drawings. Each of these elongated (3 inches) spoilers is about ¼ inch at the rim portion, tapering to about ⅛ inch at its inner end. These elongated spoilers are spaced equidistant about the geometric center of the aerodynamic toy, the center line of each two elevations or air spoilers lying on a diameter of the circular-shaped body. The air spoilers inscribed into the convex surface of the aerodynamic toy body are grooves about two inches in length, spaced equidistant angularly about three degrees apart from one another. These grooves can vary somewhat in width as desired, but a groove about 1/32 inches wide and deep will be found quite satisfactory.

Rim portion 22 is of like structural configuration to that of rim portion 11 in aerodynamic toy 10, and is integral with the main body portion 21. The convex surface 25 of the main body portion 21 blends smoothly into the outside surface of rim portion 22, as before described in connection with aerodynamic toy 10. The rim portion can be made thicker, as desired, by providing the inner surface of the rim portion of different curved configuration than the outer smooth surface, thus providing a circular rim protion of greater thickness, hence greater weight.

As shown in the drawing, centerally-located depressed protion or well 23 is of circular shape, concentric to geometric center 27 of the aerodynamic toy 20. However, it need not be of that particular configuration. It can be of irregular shape, e.g., polygonal.

In cross-section the depressed center portion 23, as seen more particularly in FIGS. 4–8 can be of various configuration, and while open at the top, i.e. on the convex side of the aerodynamic toy 20, is closed at its bottom, i.e. the depressed center portion 23 can be of cylindrical shape, in which case it is of the same diameter at the top and bottom. Or the bottom of the well 23 can be of lesser diameter than that of the open top, as shown more particularly in FIGS. 7, 8. In this case a curvilinear surface is provided, at least in part, that slants inwardly from the outer perimeter of the centrally-located well, toward the geometric center of the aerodynamic toy.

The spoilers in spoiler assembly 24 are, in general, flat, i.e., the major surfaces are planar and parallel to one another, flap-like members, and can be of rectangular configuration as are spoilers 28 (FIG. 5) disposed equidistant angularly about central axis 29. The longer top and bottom edges 30, 31 of each spoiler 28 are so aligned as to coincide with another spoiler located 180 degrees from it, the two spoilers thus being aligned with a diameter of the circular-shaped body, and the axis 29 passing through the geometric center 27 of it. The top edge 30 of spoilers 28 can be flush with the curvature of convex surface 25, i.e., the spoiler assembly 24 is entirely inset into the depressed centrally-located well 23, or it can extend somewhat above the surface, depending on the type performance desired in the aerodynamic toy.

Where a more straight or linear flight path is desired for the aerodynamic toy, the spoiler assembly should be set down into the depressed well 23 so that the top edges 30 of the spoilers are flush with convex surface 25. However, providing the top edges of the spoilers slightly above the convex surface, e.g., generally from about ⅛–¼ inches, will make for a more curved flight path, and somewhat less desirable performance and stability in flight.

Figure 6:
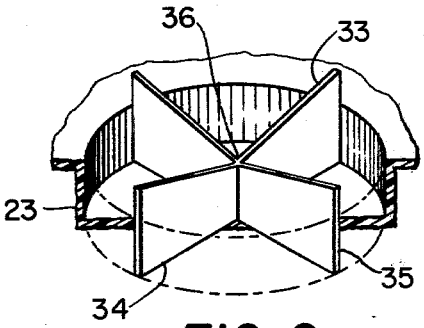
FIG. 6 is a perspective view of another configuration of a spoiler assembly that can be incorporated in the centrally-located depressed portion of the aerodynamic toy.

Contrary to the underneath or concave side 13 of the aerodynamic toy 10 shown in FIG. 1 and FIG. 2 of the drawing, the concave side 32 of aerodynamic toy 22 is not continuously smooth and uninterrupted. The smoothness of the concave side of the aerodynamic toy is interrupted by the underneath side of the centrally-located depressed portion 23. The extent to which the depressed portion 23 extends inwardly from the convex side of the aerodynamic toy toward the concave side can, of course, vary to some extent. This well can be more shallow, or deeper, depending somewhat on the particular diameter of the aerodynamic toy involved; however, in general, its depth should be no more than ¼ inch–½ inch. The diameter of the centrally-located depressed portion 23 can also vary, depending on the diameter of the toy; however, the most preferred diameter will, in general, be between 2 inches–3 inches. The spoilers in the spoiler assembly 24, as above-disclosed, need not be of a rectangular configuration. As disclosed in FIGS. 6–8, the spoilers though generally flat can be of different cross-sectional configuration. In FIG. 6 of the drawing, the top edge 33 of spoiler 34 is shown to be angled downwardly toward bottom edge 34, from the outside edge 35 toward the axial edge 36.

Figure 7:
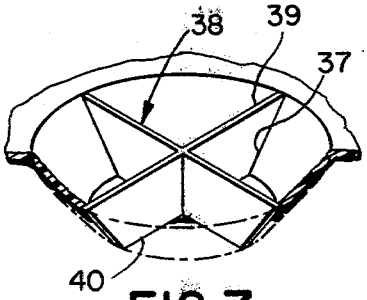
FIG. 7 shows a perspective view of another embodiment of a spoiler assembly that can be incorporated in a depressed well portion of a different internal configuration.
Figure 8:
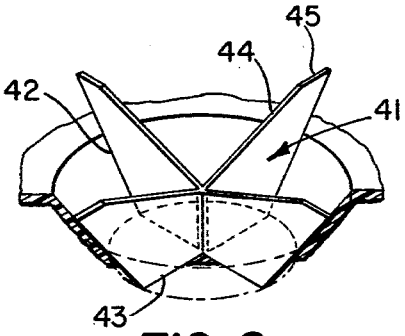
FIG. 8 discloses a perspective view of still another embodiment of a spoiler assembly provided in a centrally located depressed well portion, of a slightly different internal configuration.

Another configuration of a spoiler is disclosed in FIG. 7 wherein the outer edge 37 of spoiler 38 is seen to angle inwardly from the top edge 39 to bottom edge 40. In FIG. 8 there is disclosed a spoiler 41 of irregular configuration, in which, the lower portion of the outer edge 42 angles downwardly and inwardly, intersecting bottom edge 43 at about mid-point between the outer perimeter of well 23 and the geometric center. The upper edge 44 as shown angles downwardly from the outer edge of the spoiler to the axial edge.

It will be appreciated that where a spoiler is provided other than of rectangular configuration, the particular angulation of the sides or edges with respect to one another is of no particular significance in the practice of the invention. Moreover, where a spoiler assembly such as is shown in FIG. 8 is located so that the spoilers rise above the convex surface of the aerodynamic toy, it may be desirable to provide a flat upper edge as shown in the drawing, rather than to permit the top and outside edges to come to a point. The cross-section of the centrally-located depressed portion 23 will conform to the configuration of the cross-section of the spoiler assembly provided.

As will be appreciated, the number of spoilers provided in the spoiler assembly can be varied somewhat as desired; however, 4–8 will be found to provide satisfactory performance in most aerodynamic toys according to the invention. The spoilers must, of course, be disposed equidistant angularly about the geometric center of the aerodynamic toy, to prevent weight unbalance. The thickness of each of the spoilers should be on the order of about 1/16 inch.

Aerodynamic toys in accordance with the invention can be manufactured readily by conventional molding techniques, e.g., injection molding, and from various plastic materials such as polyvinylchloride, polyethylene, polypropylene and the like. The plastic compositions can incorporate various of the conventional compounding agents to alter the physical properties of the plastic material, as desired, e.g., density, flexibility, hardness, etc. Coloring agents can be included to provide any suitable color, or combination thereof, as desired. The spoiler assembly can be provided during the molding process, so that it will be integral with the aerodynamic toy body. However, it is possible to mold this unit seperately, if desired, and provided of such a size as to be press-fitted into the centrally-located depression of the aerodynamic toy. Thus, the spoiler assembly can be removed, as desired, in the event the spoiler assembly is not needed, because the wind is either too heavy, or too light, to give satisfactory performance.

It is of course desirable that the aerodynamci toy be of relatively light weight; however, not so light as to adversely effect its performance. The optimum weight for any particular aerodynamic toy will depend somewhat upon its particular size, i.e. diameter, and construction, e.g. number and configuration of spoilers provided. In general, however, a weight of about 1.8 grams/cubic inches volume displacement will be found satisfactory for an aerodynamic toy as shown in FIG. 3, having a diameter of about 10.5 inches.

In use, the aerodynamic toy is gripped by placing the thumb on the convex side of the toy and one or more of of the fingers the hand on the concave side. The toy is then thrown into the air with a twist of the wrist to give the aerodynamic toy a spinning impetus thereby causing it to rotate about its geometric center and to translate generally in the direction in which it is thrown. Throwing is accomplished in general by providing the aerodynamic toy horizontal to the ground.

As many different embodiments of this invention will now occur to those skilled in the art, it is to be understood that the specific embodiments of the invention as presented in this patent application are intended by way of illustration only and are not limiting on the invention, but that the limitations there on should be determined only from the appended claims.

What I claim is:

1. An aeroydynamic toy comprising a rotatable free flight body of generally circular configuration having a convex upper surface and a smooth, uninterrupted, concave bottom surface, a rim portion comprising an outer surface and an inner surface integral with and defining the circumferential perimeter of the aerodynamic toy body, said outer surface forming a smooth continuous surface with the said convex surface and said outer surface of the rim portion curving downwardly and inwardly whereby said outer surface has somewhat the same shape of a parabola opening inwardly toward the center of the circular shaped body, and a plurality of radially extending air spoilers on said convex upper surface disposed equidistant angularly around the geometric center of the aerodynamic toy.

2. An aerodynamic toy according to claim 1 wherein the radially extending air spoilers are defined by a plurality of grooves inscribed in the convex upper surface of the aerodynamic toy, said grooves each being in alignment with a radius of the circular shaped body.

3. An aerodynamic toy according to claim 1 wherein the radially extending air spoilers are each defined by an elongated raised portion above the convex surface, said elongated raised portion being of arcuate shape and cross-section, and the center line of each said arcuate shaped raised portion being in alignment with a radius of the circular-shaped body.

4. An aerodynmaic toy according to claim 1 wherein the radially extending air spoilers are elevations above the convex surface defined by adjacent radii of the circular-shaped body, said elevations being of greater width nearer the rim portion than nearer the geometric center of the aerodynamic toy.

5. An aerodynamic toy according to claim 1 wherein the radially extending air spoilers are elevations above the convex surface, the center lines of which elevations are each in alignment with a radius of the circular-shaped body and the width of each elevation is greater nearer the geometric center of the aerodynamic toy than at its rim portion.

6. An aerodynamic toy according to claim 1 wherein the inner surface of said rim portion defines a cylindrical surface concentric with the geometric center of the aerodynamic toy whereby the rim portion is of greater thickness than the thickness between said convex surface and said concave surface of the main body.

7. An aerodynamic toy comprising a rotatable free flight body of generally circular configuration having a convex upper surface and a concave bottom surface, a depressed center portion in said convex-concave body having an open top and being closed at its bottom, said center portion extending a predetermined distance inwardly toward the concave side of the convex-concave body, a rim portion comprising an outer surface and an inner surface integral with and defining the circumferential perimeter of the aerodynamic toy body, said outer surface forming a smooth continuous surface with the said convex surface and said outer surface of the rim portion curving downwardly and inwardly whereby said outer surface has somewhat the same shape of a parabola opening inwardly toward the center of the circular shaped body, and a plurality of radially extending air spoilers on said convex upper surface disposed equidistant angularly around the geometric center of the aerodynamic toy.

8. An aerodynamic toy according to claim 7 wherein said depressed center portion is of cylindrical shape.

9. An aerodynamic toy according to claim 7 wherein the open top of the depressed center portion is defined by a circle of pre-determined radius concentric with the geometric center of the aerodynamic toy and the said closed bottom is defined by a circle of lesser radius whereby the sides of the depressed center portion are curvilinear extending inwardly from top to bottom.

10. An aerodynamic toy according to claim 7 wherein the toy further comprises a centrally-disposed spoiler assembly comprising a plurality of spoilers located equidistant angularly about a central axis, each of which spoilers is of planar configuration in the axial direction, said spoiler assembly being located in the depressed center portion in such a manner that the axis thereof passes through the geometric center of the aerodynamic toy and the spoilers are in alignment with a diameter of the circular-shaped body.

11. An aerodynamic toy according to claim 10 wherein the spoilers in the spoiler assembly are each of a rectangular configuration.

12. An aerodynamic toy according to claim 11 wherein the spoilers in the spoiler assembly are each of the same dimension and extend above the convex surface of the aerodynamic toy.

13. An aerodynamic toy according to claim 10 wherein each of said spoilers in said spoiler assembly is of lesser axial length near the center axis than at its outer edge.

14. An aerodynamic toy according to claim 10 wherein each of said spoilers in the spoiler assembly is of greater length at its top edge than at its bottom edge.

15. An aerodynamic toy according to claim 14 wherein the top edge of each spoiler in said spoiler assembly angles downwardly toward the bottom edge in a direction toward the center axis.

* * * * *